United States Patent [19]

Motomura et al.

[11] 4,335,778

[45] Jun. 22, 1982

[54] APPARATUS FOR MEASURING INJECTION SPEEDS OF DIE CASTING MACHINES

[75] Inventors: Noriyuki Motomura; Hiroyuki Tsuboi, both of Zama, Japan

[73] Assignee: Toshiba Kikai Kabushiki Kaisha, Tokyo, Japan

[21] Appl. No.: 153,624

[22] Filed: May 27, 1980

Related U.S. Application Data

[63] Continuation-in-part of Ser. No. 941,869, Sep. 13, 1978, abandoned.

[30] Foreign Application Priority Data

Sep. 20, 1977 [JP] Japan ..... 52-113011

[51] Int. Cl.[3] ..... B22D 17/32

[52] U.S. Cl. ..... 164/150; 164/314; 425/169

[58] Field of Search ..... 164/4, 113, 119, 120, 164/150, 154, 157, 284, 155, 133, 303, 312; 425/169

[56] References Cited

FOREIGN PATENT DOCUMENTS 2021739 10/1971 Fed. Rep. of Germany ..... 164/4

1069734 5/1967 United Kingdom ..... 164/155

*Primary Examiner*—Robert D. Baldwin

*Assistant Examiner*—K. Y. Lin

*Attorney, Agent, or Firm*—Koda and Androlia

[57] ABSTRACT

Apparatus for measuring injection speeds of a die casting machine comprises a detecting device for detecting injection times at low and high speed injection strokes, calculating elements for calculating low and high injection speeds by dividing the low and high injection strokes by the injection times, and displaying elements for displaying the low and high injection speeds as average injection speeds. The injection time detecting device includes an elongated member having different magnetic characteristics, an element responsive to the characteristics to generate pulse signal, low and high speed injection limit switches, and a discriminating element for discriminating the period of the signal generated by the pulse signal generating element. The injection speeds of the die casting machine can be measured and displayed by the interrelative operations of the elements and devices described above.

8 Claims, 10 Drawing Figures

APPARATUS FOR MEASURING INJECTION SPEEDS OF DIE CASTING MACHINES

CROSS REFERENCE TO RELATED APPLICATIONS

This invention is a continuation-in-part application of No. 941,869 filed Sept. 13, 1978, now abandoned.

BACKGROUND OF THE INVENTION

This invention relates to a die casting machine and more particularly apparatus for automatically measuring the injection speeds of an injection cylinder of the die casting machine.

In the operation of a die casting machine, it is known that the continuous operation thereof has been performed by presetting the starting positions for low and high speed injections and the positions at which the injection speed is changed from low to high in accordance with the desired size, shape and thickness of the cast products.

Usually, although a test casting operation has been performed to find out necessary conditions for continuously operating the die casting machine, the starting positions for the low and high speed injections and the position at which the injection speed is changed from low to high are properly determined by repeatedly observing the qualities of the cast products. However, in an actual continuous casting operation of the die casting machine, the injection speed does not often coincide with that obtained in the test casting operation because of disturbances such as an insufficient lubrication for the plunger and the sleeve of an injection unit, irregular motion and seizure between the plunger and sleeve, and the variation in the viscosity of the oil used for operating an injection cylinder. Therefore, it is required to readjust the injection speed in the actual continuous operation of the die casting machine.

SUMMARY OF THE INVENTION

Accordingly, an object of this invention is to provide a die casting machine having an apparatus capable of measuring the injection speed without any appreciable measuring error.

According to this invention, the above object is performed by providing apparatus for measuring injection speeds of a die casting machine. The apparatus comprises detecting means for detecting injection times at low and high speed injection strokes, respectively, calculating means for arithmetically calculating low and high injection speeds by dividing the low and high injection strokes by the injection times, and displaying means for displaying the low and high injection speeds as average injection speeds. The injection time detecting means comprises an elongated member provided with a plurality of axially spaced portions having different magnetic characteristics, an element responsive to the different magnetic characteristics for generating a pulse signal having a period corresponding to the injection speed of the die casting machine, low and high speed injection limit switches operated by the elongated member for generating signals when low speed injection is started and when the injection speed is switched from low to high, a signal generator, an AND gate circuit with one input connected to the low speed injection limit switch and the other input connected to receive an output of the signal generator, first determining means responsive to the output of the AND gate circuit for determining the low speed injection time and stroke, a discriminating element for discriminating the period of the signal generated by the pulse signal generating element, and second determining means responsive to the signal generated by the high speed injection limit switch, to the output of the discriminating element and to the output of the AND gate circuit for determining the high speed injection time and stroke.

BRIEF DESCRIPTION OF THE DRAWINGS

In the accompanying drawings

DESCRIPTION OF THE PREFERRED EMBODIMENTS

Figure 1:
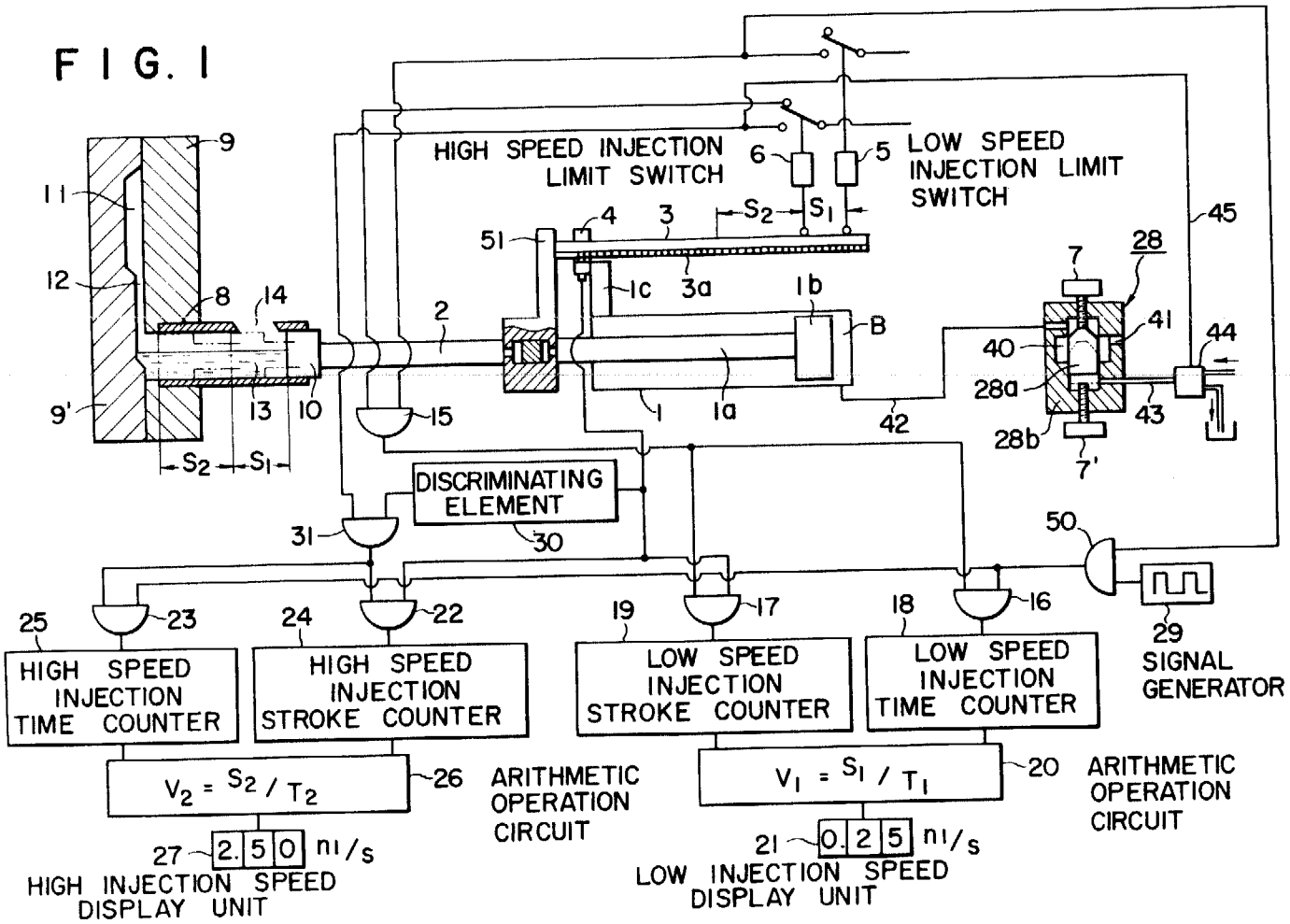
FIG. 1 is a diagrammatic view showing one embodiment of a die casting machine having an injection unit provided with an apparatus for accurately measuring the injection speeds according to this invention.

Referring to FIG. 1, a metal mold of a die casting machine comprises a stationary mold 9 and a movable mold 9' which define a cavity 11 therebetween when they are closed. A sleeve 8 provided with an opening 14 for pouring molten metal 13 is secured to the stationary mold 9. The molten metal 13 is injected into the cavity 11 under a pressure given by a plunger 10 moved through the sleeve 8. The plunger 10 is connected through a rod 2 to an injection rod 1*a* which is integrally formed with an injection piston 1*b* slidably contained in an injection cylinder 1. The rod 2 is connected through a support 51 to a bar 3 for operating a limit switch unit including low and high speed injection switches 5 and 6, and the bar 3 is graduated with a magnetic scale 3*a*.

A bracket 1*c* is secured to one end of the outer surface of the injection cylinder 1 and a magnetic head 4 cooperating with a magnetic scale 3*a* for generating pulses in accordance with the movement of the magnetic scale 3*a* is attached to the bracket 1*c*. A valve unit 28 is provided for controlling the flow of operating fluid into the chamber B of the cylinder 1 through pipe 42 for driving the piston rod 1*a*. The valve unit 28 comprises a casing 28*b* into which a valve body 28*a* is slidably fitted and handles 7 and 7' for adjusting low and high injection speeds, respectively, which handles 7 and 7' are disposed on the opposite sides of the valve body 28*a* along the axis thereof. An annular groove 40 is formed on the inner side of the casing 28*b*, and the upper end of the annular groove 40 is communicated with a source of the operating fluid through an inlet port 41. When handles 7 and 7' are adjusted, valve body 28*a* is moved vertically to control the degree of opening between the inlet port 41 and the outlet pipe 42, thus controlling the flow of the operating fluid fed into the chamber B of the injection cylinder 1.

The limit switch 5 generates an electrical signal which confirms that the injection piston 1*b* is positioned at the return position (rightward limit position in FIG.

1) and starts the measurement of the low injection speed, whereas the limit switch 6 generates an electric signal for switching the low injection speed to the high injection speed and an electric signal for starting the measurement of the high injection speed.

The injection cylinder 1 operates as follows.

When molten metal is poured into the sleeve 8 through the opening 14, the injection piston 1*b* advances (leftwardly as viewed in FIG. 1) at a low speed by an oil amount determined by the low injection speed adjusting handle 7 which is set by a start signal, not shown. In this operation, the stroke $S_1$ of the bar 3 at the low injection speed is determined by the position at which the high speed injection limit switch 6 has been set. In other words, the stroke $S_1$ corresponds to the stroke of the plunger 10 for pouring the molten metal into the gate 12 of the cavity 11. After the injection piston 1*b* has moved over the stroke $S_1$, the high injection limit switch 6 operates, whereby the high injection speed adjusting handle 7' is moved downwardly by the valve body 28*a* in response to a control circuit to advance (leftwardly as viewed in FIG. 1) the injection piston 1*b* at a high speed. The stroke $S_2$ of bar 3 at the high injection speed is equal to the stroke of the plunger 10 to completely charge the molten metal 13 into the cavity 11 defined by the metal molds 9 and 9'.

The apparatus for measuring the injection speed according to this invention is constructed and operates as follows.

The limit switch 6 is connected through a line 45 to solenoid valve means 44. When this solenoid valve means operates in response to the signal from the limit switch 6, pressurized liquid is admitted into the valve casing 28*b* between its bottom and the valve body 28*a* through the solenoid valve means and a pipe 43, thus raising the valve body. The upper position of the valve body 28*a* is determined by low speed handle 7. Thus, the quantity of the operating fluid supplied from the inlet 41 to the chamber B of the cylinder 1 and hence the speed of the piston 1*b* is determined by the handle 7. When the solenoid valve means 44 is deenergized, the pressurized liquid is discharged out of the valve casing 28*b* so that the valve body is lowered to increase the quantity of the operating fluid thereby increasing the speed of the piston 1*b*. The lower position of the valve body is determined by the high speed handle 7'.

When the injection piston rod 1*a* advances, the bar 3 for operating the limit switch unit also advances in unison with the movement of the piston rod 1*a* and a pulse signal is then generated from the magnetic head 4. This pulse signal is transmitted to one inputs of AND gate circuits 17 and 22 which operate circuits which count the stroke of the low and high speed injections. At the same time, with the generation of the pulse signal from the magnetic head 4, the limit switch 5 operates to generate a signal which enables AND gate circuit 15 so as to apply its output to one inputs of AND gate circuits 16 and 17.

When the limit switch 5 becomes operative, a signal generated thereby is also applied to an AND gate circuit 50 as one input thereof and a signal generator 29 applies a signal to the AND gate circuit 50 as the other input thereof. When the AND gate circuit 50 is thus enabled, an output thereof is applied to the AND gate circuit 16 as the other input thereof. Since the pulse signals from the limit switch 5 and the magnetic head 4 are applied to the inputs of AND gate circuit 17, it is also enabled.

In this manner the pulse signals from the signal generator 20 through the AND gate circuit 50 and the magnetic head 4 pass through the AND gate circuits 16 and 17 and are counted by a low speed injection time counter 18 and a low speed injection stroke counter 19, respectively. When the piston rod 1*a* is further advanced, the limit switch 5 becomes inoperative and the high speed injection limit switch 6 then operates to disenable the AND gate circuit 15, thereby disenabling the AND gate circuits 16 and 17. Thus the measurements of the counters 18 and 19 are completed. The counted values are applied to and operated by an arithmetic operation circuit 20 and the calculated speed is digitally displayed by a low injection speed display unit 21. Regarding the high speed injection, when the limit switch 6 operates, the valve body 28*a* is moved downwardly towards the high speed injection adjusting handle 7' as shown by a dotted line shown in FIG. 1, and the bar 3 advances at high speed. The magnetic head 4 generates a high frequency pulse signal during the high speed advancement of the bar 3 and this signal is applied to one input of the AND gate circuit 22 in the same manner as in the case of the low speed injection described above.

The signal from the limit switch 6 is applied to one input of an AND gate circuit 31, and the pulse signal from the magnetic head 4 is applied to the other input of the AND gate circuit 31 through a pulse frequency discriminating element 30, whereby the AND gate circuit 31 is enabled to enable the AND gate circuits 22 and 23. The pulse signals passing through the AND gate circuits 22 and 23 are counted by a high speed injection time counter 24 and a high speed injection stroke counter 25, respectively. The counted values are applied to and operated by an arithmetic operation circit 26 and the calculated speed is digitally displayed by a high injection speed display unit 27.

However, in the measurement of the high injection speed, there exists a problem that there is no unit corresponding to the high speed injection limit switch 6 used for setting a measuring range of the low injection speed.

In order to obviate this problem, according to this invention, a discriminating element 30 for discriminating the pulse frequency is arranged between the AND gate circuits 22 and 31. The discriminating element 30 detects the time when a pulse having long period is generated from the magnetic head 4 when the injection piston rod 1*a* stops, whereby signals to be applied to the AND gate circuits 22 and 23 are interrupted by the AND gate circuit 31 by the signal generated by the discriminating element 30, thus completing the counting operations of the counters 24 and 25.

Figure 2A:
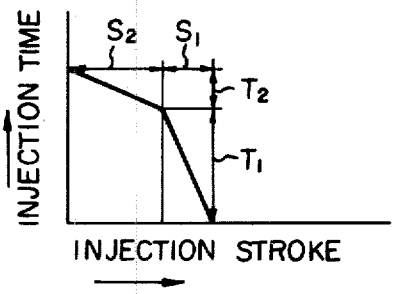
FIGS. 2*a* and 2*b* are graphs respectively showing the relationships of the operating conditions of the die casting machine.
Figure 2B:
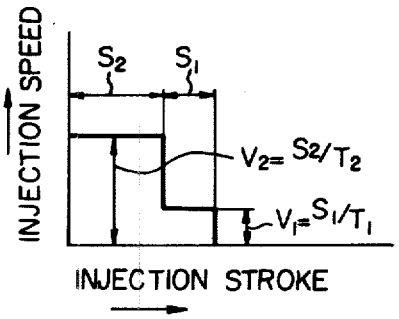

As is understood from the foregoing descriptions, according to this invention, the low and high injection speeds can be displayed as average speeds, i.e.

$$V_1 = \frac{S_1}{T_1} \text{ and } V_2 = \frac{S_2}{T_2},$$

which are shown in FIGS. 2*a* and 2*b*, where $S_1$ is a distance that the bar 3 advances at a low speed; $S_2$ is a distance that the bar 3 advances at a high speed; $T_1$ is a time that the bar 3 advances at a low speed; and $T_2$ is a time that the bar 3 advances at a high speed.

Figure 2C:
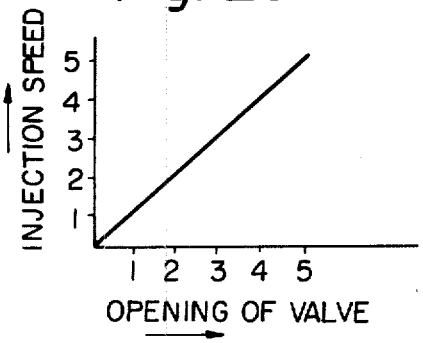
FIG. 2*c* is a graph showing the relationship between the injection speed and the opening of a valve for regulating the injection speed.
Figure 3:
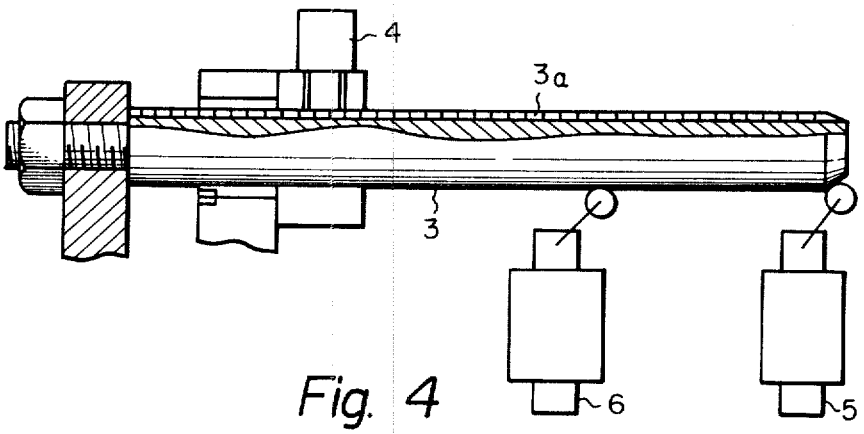
FIG. 3 is a schematic enlarged view of the pulse generating means shown in FIG. 1.

By measuring the low and high injection speeds in this manner, the injection speeds can be corrected by utilizing the relationship between the opening of the valve 28 and the injection speed as shown in FIG. 2*c*.

Figure 4:
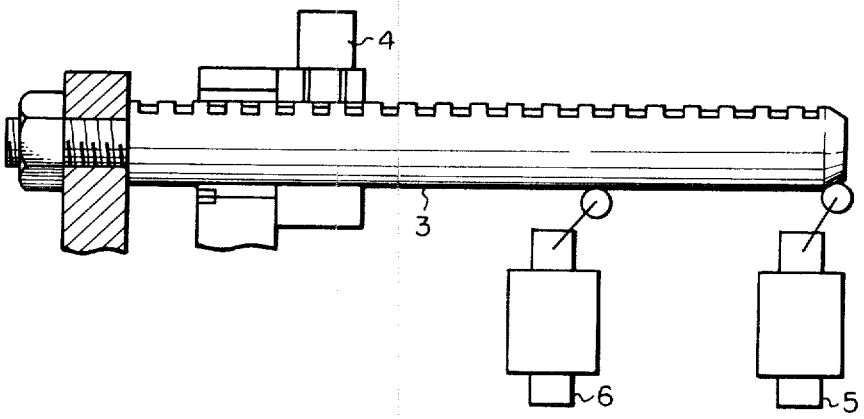
FIGS. 4 through 8 show modified embodiments of the pulse generating means shown in FIG. 3.
Figure 5:
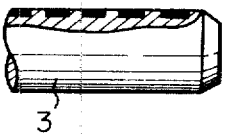
Figure 6:
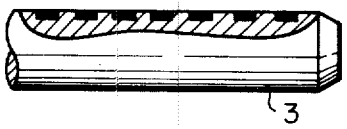
Figure 7:
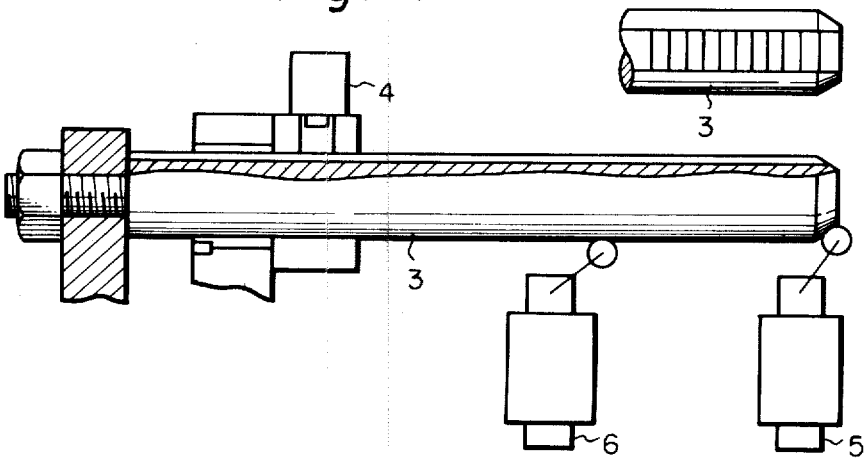

FIGS. 4 through 7 show modified examples of the magnetic scale 3*a*, wherein FIG. 4 shows a bar made of a magnetic material and provided with equally pitched grooves for operating the magnetic head 4, FIG. 5 shows the same bar as shown in FIG. 4, but the grooves are filled with non-magnetic material, FIG. 6 shows a bar made of non-magnetic material and provided with grooves filled with magnetic material and FIG. 7 shows a bar in which a photoelectric tube 4 is used instead of the magnetic head 4 shown in FIG. 4 and the bar 3 is provided with colored mesh pattern or materials having different light reflectivities which are alternately arranged on the bar along the length thereof.

Figure 8:
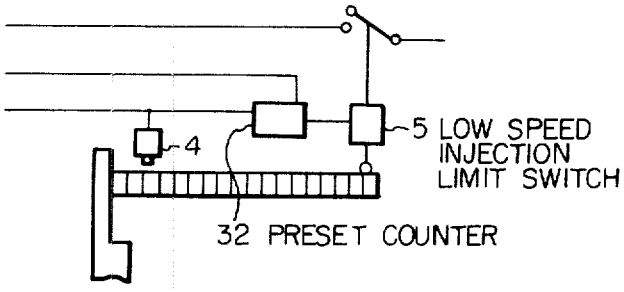

According to the embodiments shown in FIGS. 1 through 5, the high speed injection switch must be moved every time when it is required to change the position for switching the low speed injection to the high speed injection, but in the other embodiment shown in FIG. 8, A preset counter 32 with a preset number in which a low speed injection stroke is preset was used instead of a high speed injection limit switch 6 to transmit the signals from the magnetic head 4; and the present counter 32 counts the pulse signals from the magnetic head 4 when the limit switch 5 is turned ON and generates a signal when the preset number is counted. Accordingly the injection rod 1*a* is changed from the low speed injection to the high speed injection by the signal generated from the preset counter 32.

Therefore, according to this invention, there is provided an apparatus for measuring the injection speed of a die casting machine having substantially no measuring error and the injection speed determined in a test casting operation can easily be realized in an actual continuous casting operation.

We claim:

1. Apparatus for measuring injection speeds of a die casting machine comprising means for detecting injection times at low and high speed injection strokes, respectively, means for arithmetically calculating low and high injection speeds by dividing said low and high injection strokes by said injection times, and means for displaying said low and high injection speeds as average injection speeds, said injection time detecting means comprising an elongated member provided with a plurality of axially spaced portions having different magnetic characteristics, means responsive to said different magnetic characteristics for generating a pulse signal havig a period corresponding to the injection speed of the die casting machine, low and high speed injection limit switches operated by said elongated member for generating signals when low speed injection is started and when the injection speed is switched from low to high, a signal generator, an AND gate circuit with one input connected to said low speed injection limit switch and the other input connected to receive an output of said signal generator, first determining means responsive to the output of said AND gate circuit for determining the low speed injection time and stroke, means for discriminating the period of the signal generated by said pulse signal generating means, and second determining means responsive to the signal generated by said high speed injection limit switch, to the output of said discriminating means and to the output of said AND gate circuit for determining the high speed injection time and stroke.

2. The apparatus according to claim 1 wherein said discriminating means further operates so as to detect the completion of high-speed injection and a period of a pulse signal generated when said high speed injection is made is measured by an electric signal connected to an output of said discriminating means, said electric circuit including a gate circuit judging a point at which said pulse signal coincides with a given period as a point of the completion of the high-speed injection thereby calculating the high injection speed.

3. The apparatus according to claim 1 which further comprises digital means for setting the low injection speed range for measuring said low injection speed.

4. Apparatus according to claim 1 wherein said elongated member comprises an elongated magnetic scale and said pulse signal generating means comprises a magnetic head.

5. Apparatus according to claim 1 wherein said elongated member is provided with a plurality of grooves of equal pitches.

6. Apparatus according to claim 1 wherein said elongated member is made of a nonmagnetic material provided with a plurality of grooves of equal pitches and filled with a magnetic material.

7. Apparatus according to claim 1 wherein said pulse generating means comprises a photoelectric tube and said elongated member is provided with a colored mesh pattern.

8. Apparatus according to claim 1 wherein said elongated member comprises sections made of materials having different light reflectivities and are arranged alternately along the length thereof.

* * * * *